US005549298A

United States Patent [19]

Cullen et al.

[11] Patent Number: 5,549,298

[45] Date of Patent: Aug. 27, 1996

[54] GOLF ALIGNMENT APPARATUS

[76] Inventors: Susan J. Cullen; Hugh L. Cullen, both of 1933 Gamel Way #2, Mountain View, Calif. 94040

[21] Appl. No.: 419,003

[22] Filed: Apr. 7, 1995

[51] Int. Cl.[6] ..... A63B 69/36

[52] U.S. Cl. ..... 473/272

[58] Field of Search ..... 273/187 R, 183.1, 273/32 R, 32 B, 32 D, 32 H

[56] References Cited

U.S. PATENT DOCUMENTS

| | | | |
|---|---|---|---|
| 4,257,608 | 3/1981 | Funk | 273/187 R |
| 4,354,683 | 10/1982 | Woolland | 273/187 R |
| 4,563,010 | 1/1986 | McDorman et al. | 273/187 R |
| 4,583,739 | 4/1986 | Kabbany | 273/187 R |
| 4,647,048 | 3/1987 | Welch | 273/187 R |
| 4,657,258 | 4/1987 | Melov et al. | 273/187 R |
| 4,718,674 | 1/1988 | Henry | 273/186 C |
| 4,736,952 | 4/1988 | Taft et al. | 273/187 R |
| 4,779,872 | 10/1988 | Bisbee | 273/187 R |
| 4,784,390 | 11/1988 | Horgen | 273/187 R |
| 4,784,393 | 11/1988 | Williams et al. | 273/187 R |
| 4,805,913 | 2/1989 | Bott | 273/187 R |
| 4,871,175 | 10/1989 | Levin et al. | 273/187 R |
| 4,900,030 | 2/1990 | Houtz | 273/187 R |
| 4,919,432 | 4/1990 | Coggins et al. | 273/187 R X |
| 4,921,254 | 5/1990 | Buckley | 273/183 B |
| 4,925,192 | 5/1990 | Forbes | 273/187 R |
| 4,927,153 | 5/1990 | Schaefer | 273/187 R |
| 4,993,716 | 2/1991 | Waller | 273/183 B |
| 4,998,731 | 3/1991 | Bowen | 273/183 B |
| 5,013,044 | 5/1991 | Hesselbart | 273/186 C |
| 5,014,994 | 5/1991 | Peters | 273/187 R |
| 5,040,790 | 8/1991 | Anthes et al. | 273/186 R X |
| 5,042,815 | 8/1991 | Sutton | 273/187 R |
| 5,052,114 | 10/1991 | Levenson et al. | 33/286 |
| 5,062,643 | 11/1991 | Bibbey et al. | 273/188 A |
| 5,067,717 | 11/1991 | Harlan et al. | 273/183 B |
| 5,069,456 | 12/1991 | Bellagamba | 273/183 E |
| 5,076,580 | 12/1991 | Lang | 273/26 R |
| 5,083,789 | 1/1992 | Hickson | 273/187 R |
| 5,108,106 | 4/1992 | Cook | 273/187 R |
| 5,110,132 | 5/1992 | Weston et al. | 273/187 R |
| 5,110,133 | 5/1992 | Durso | 273/187 R |
| 5,116,058 | 5/1992 | Theriault | 273/183 E |
| 5,118,112 | 6/1992 | Bregman et al. | 273/183 A |
| 5,139,263 | 8/1992 | Feo | 273/186.1 |
| 5,139,264 | 8/1992 | Wootten | 273/191 R |
| 5,141,232 | 8/1992 | Durso | 273/187 R |
| 5,154,427 | 10/1992 | Harlan et al. | 273/187 R |
| 5,171,017 | 12/1992 | Betancourt | 273/187 R |
| 5,180,168 | 1/1993 | Balestrieri | 273/186.3 |
| 5,190,284 | 3/1993 | Diaz | 273/187 R X |
| 5,197,739 | 3/1993 | Johnson, III | 273/187 B |
| 5,203,453 | 4/1993 | Dirito | 273/187 R X |
| 5,221,088 | 6/1993 | McTeigue et al. | 273/187.2 |
| 5,224,709 | 7/1993 | Buck, Jr. | 273/187 R X |
| 5,246,234 | 9/1993 | Zambelli | 273/187 R |

*Primary Examiner*—William H. Grieb

*Attorney, Agent, or Firm*—Blakely, Sokoloff, Taylor & Zafman

[57] ABSTRACT

A golf alignment device that has a ground arm for placement parallel to a line directed at a target some distance away from a golfer and a ball placement line arm coupled to the grounded arm for indicating the ball placement with respect to the golfer and the target line, so that a golfer is aided in maintaining a perpendicular relationship between the two. Using such a device, a golfer is able to practice his swing for a variety of club faces.

19 Claims, 9 Drawing Sheets

GOLF ALIGNMENT APPARATUS

FIELD OF THE INVENTION

The present invention relates to the field of golfing aid; more particularly, the present invention relates to helping improve the positioning and alignment of a golfer.

BACKGROUND OF THE INVENTION

Golfers often have difficulty lining up golf shots. It is very easy for a golfer to lose the target line that runs from the golf ball on the tee to the green or a point in the fairway, especially when the target is a great distance away. This difficulty is accentuated by the fact that the golfer is attempting to line up such a shot while setting up squarely to a golf ball directly in front of them while that target line extends far into the distance. In other words, maintaining a target line at a 90° angle to the ball placement line when the target distance is 100 to 400 yards away causes difficulty in attaining the proper alignment. In fact, the margin for error is great in golf unless the alignment to the target line can be consistently observed or maintained. Alignment errors one inch to the right or to the left of the target line near the position of the golf ball can have a drastic effect on the ultimate direction the ball takes during flight.

Prior art golf aids exist that assist the practicing golfer in such areas as addressing the golf ball correctly, with the proper stance, swing, or ball placement. One of the problems with certain golf aids in the prior art is that the devices are often too cumbersome in design for use as a portable device in the fairway or even during driving range practice. That is, the prior art suggests pocket portability for practice purposes but there is no embodiment which illustrates the feasibility for such a design. In addition, because they are cumbersome, these designs often do not lend themselves to the possibility of a miniature configuration. For example, see U.S. Pat. No. 4,563,010.

Another problem is that prior art golf aid designs create distractions on the ground in front of a practicing golfer. For instance, see U.S. Pat. Nos. 5,110,132, 5,224,709, and 5,246,234. It is desirable to provide a golf aid that is less of a distraction than those of the prior art.

One prior art embodiment uses tape to make a perpendicular line which is too flexible. For the marked tapes may malfunction too easily. See U.S. Pat. No. 5,203,453.

Another problem with some prior art golf alignment aids is that they do not offer a means to individualize or customize indicators on the alignment device. For instance, certain golf aids allow notations to be made on certain pieces of equipment; however, there is no means for personalizing club and ball locators.

The present invention enables the golfer to create a perpendicular relationship between the ball line and the target line. The present invention provides a portable golf alignment aid for fairway and driving range practice that is flexible for ease of club face location selections and may be customized to allow easy location of club face placement for a particular golfer.

SUMMARY OF THE INVENTION

A golf alignment apparatus is described. A golf alignment apparatus of the present invention includes a first elongated member that is placed parallel to a target line that is set forth and chosen by a golfer. This elongated member includes visible indicia corresponding to ball placements for individual golf clubs. The indicia are located on the first elongated member with respect to the foot of the golfer that is close to the target. The golf alignment device further includes a connector that slides on the first elongated member moving in direction perpendicular to that member. A second elongated member removably attached to the connector maintains a perpendicular relationship to the first elongated member to provide a ball placement line based on individual golf club selection by the golfer.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PRESENT INVENTION

A golf alignment apparatus is described. In the following detailed description of the present invention, numerous specific details are set forth, such as lengths, material types, etc., in order to provide a thorough understanding of the present invention. However, it will be apparent to one skilled in the art that the present invention may be practiced without these specific details. In other instances, well-known structures and devices are shown in block diagram form, rather than in detail, in order to avoid obscuring the present invention.

Figure 1:
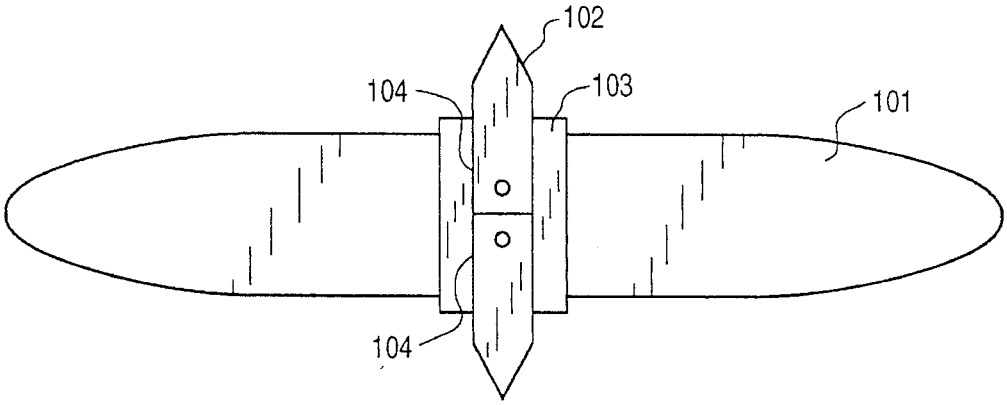
FIG. 1 illustrates a top view of one embodiment of the golf alignment device of the present invention.

FIG. 1 illustrates one embodiment of the golf alignment device of the present invention. Referring to FIG. 1, the golf alignment device 100 comprises a ground arm (e.g., elongated member) 101, a ball placement line arm (e.g., elongated member) 102 coupled to the ground arm 101 via connector 103.

The ground arm 101 is placed parallel to a target line to the target selected by a golfer to assist the golfer in drawing the imaginary line from the placement of the ball to the target green or fairway location. Note that such an imaginary line may extend to a point in the fairway on the way to the green, to the green itself, or any location chosen by the golfer.

The ball placement line arm 102 is coupled to the ground arm 101 via connector 103. Using connector 103, the ball placement line arm 102 slides in a direction perpendicular to the ground arm 101 in order to select a club face placement and to square a golfer to the ball position. Because of the slidability of the ball placement line arm 102, a golfer is able to select multiple club face positions freely, while maintaining arm 102 in proper formation so as not to lose the ball placement line. The ball placement line arm 102 is shaped such that arm 102 points to the ball placement position. In one embodiment, at least one end of the ball placement line arm 102 comes to a point.

Figure 2:
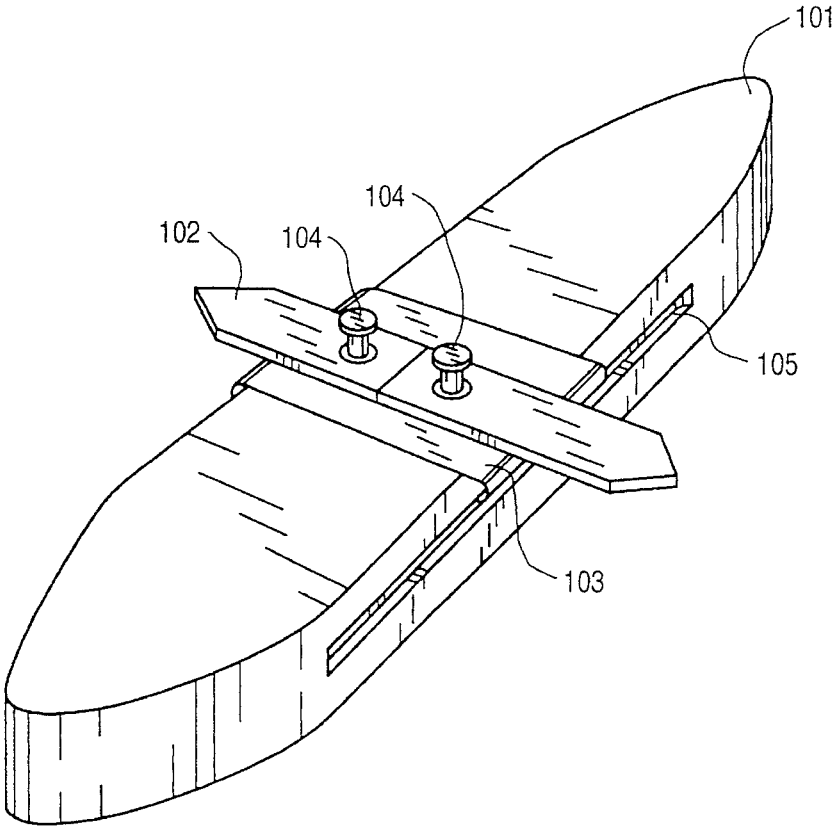
FIG. 2 is a perspective view of one embodiment of the present invention.

Connector 103 slides fluidly along the ground arm 101. In one embodiment, ground arm 101 includes two tracks along its sides that enables the connector 103 to move in a direction parallel to the target line. FIG. 2 illustrates one of such tracks in a perspective view of one embodiment of the golf alignment apparatus of the present invention. Note that connector 103 slides uninhibited by the ground upon which the ground arm 101 lies (assuming the surface upon which the golf alignment apparatus rest is relatively flat). In other words, the connector 103 avoids contact with the ground as it slides. The connector 103 wraps around the top portion of the ground arm and into the track, as shown in FIG. 2, and is designed to slide into each club face position unimpeded, yet firm enough to hold the ball placement line.

The present invention uses the ground arm 101 to help a golfer in drawing a first imaginary line from the tee to the target green where the ball will ultimately be directed, while the ball placement line arm 102 helps the golfer project another imaginary line from and perpendicular to the ground arm 101 to the golf ball placement on the tee or ground where the club face will ultimately connect with the ball.

Figure 3:
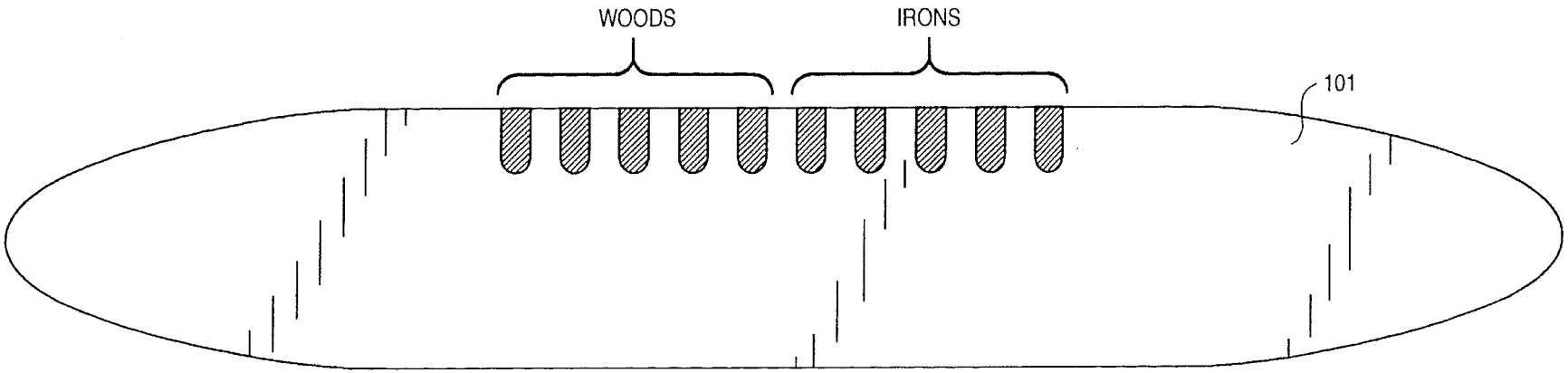
FIG. 3 illustrates one embodiment of the visible indicia on the grounded arm of the present invention.

Because golfers use a variety of different clubs, the ground arm 101 contains visible indicia that set forth specific locations for the placement of the ball with respect to individual golf clubs (e.g., woods, irons). That is, the visible indicia, or club face locators, appear on the ground arm 101 to enable a golfer to select proper placement of the ball based on their club selection. An example of such visible indicia are shown in FIG. 3.

In one embodiment, the visible indicia may be prefabricated lines, markings, pointers, etc. on the ground arm 101. In another embodiment, the visible indicia may be self applied, or attached, indicia, such as multiple tape indicators. Note that the ground arm 101 may include prefabricated lines or markings, which a golfer may use as references to personalize club face locators using self-applicable markers or tape. By allowing golfer's to set the visible indicia based on their physical make-up, stance, and swing, the present invention allows customization of the golf alignment apparatus.

The connector 103 and arm 102, or portions thereof, may be transparent to enable reading of the indicia on ground arm 101. In another embodiment, the connector 103 includes a hole or gap region that may be positioned over the visible indicia to enable reading club face locations. Note that such transparency or connector configuration may not be necessary where the side of the connector 103 is aligned with one of the visible indicia when selecting the ball line placement associated with its club face location.

The golf alignment apparatus of the present invention may be used in two ways. First, the golf alignment apparatus may be used to align a golfer when a ball is already placed on the ground and a target is selected. In this case, an individual places the ground arm 101 in a position parallel to the target line such that the ball is located in the plane that is perpendicular to the ground arm 101 (and the target line). Then the golfer moves arm 102 to the desired club face location based on their club selection. The golf alignment apparatus of the present invention is then repositioned such that a pointed end of the arm 102 points to the golf ball while the ground arm 101 remains parallel to the target line. Once the golf alignment apparatus has been repositioned, the golfer takes their stance such that the foot closest to target lines up with the forward most ball placement position of the ground arm 101. It should be noted that the placement of the golfer's feet with respect to the ground arm 101 is the same regardless of the ball placement line (or club face selection). At that point, the individual may swing a golf club at the positioned ball.

Second, the golf alignment apparatus of the present invention may be used to set a golf ball in position when a target has been selected and the golfer desires to swing a particular golf club to hit the ball. In this case, an individual places the ground arm 101 in a position parallel to the target line. Then the individual moves arm 102 to the desired club face location based on their club selection. Once positioned, the individual places their golf ball on the ball placement line indicated by the point of arm 102. At that point, the individual may swing a golf club at the positioned ball.

Figure 12:
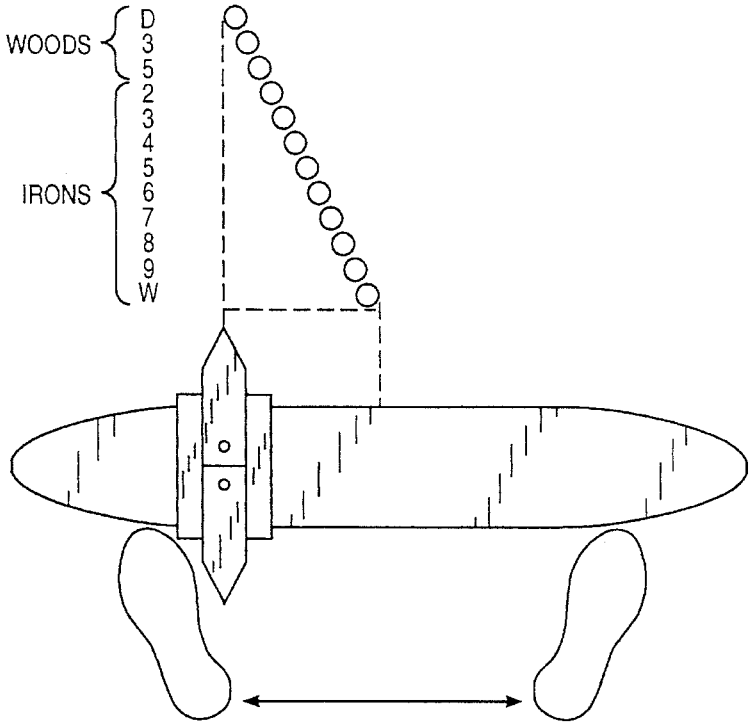
FIG. 12 illustrates the ball placement positions for multiple golf club selections with respect to the golf alignment device of the present invention for a right-handed golfer.

The golf ball placement and positioning with respect to the golf alignment device of the present invention is illustrated in FIG. 12. Referring to FIG. 12, the ground arm 101 is placed immediately in front of the toes of the left foot (in case of a right-handed golfer). The toes of the right foot may approach the ground arm 101 or may be dropped back directly from ground arm 101 after its placement. The golfer's feet are placed approximately shoulder width apart with the inside heel of the left front foot aligned with the first ball placement position. Note that the weight distribution moves from the left foot to the right foot until the 9 iron is played off the right heel.

In an embodiment, the ball placement positions of four woods and seven irons are shown in FIG. 12 running from the inside left head to a point approximately at the center point between the two feet. The ball placement positions of the woods are farther away from the ground arm than that of the irons. This is because the woods have longer shafts, while the irons are played closer to the body. The exact distance away that a golf ball is placed from an individual is based on the individual's size, stance, and club lengths. Typically, the handle (or grip) end of a golf club is balanced approximately slightly below belt-level on an individual and is then allowed to extend naturally the length of golf club away from the golf ball, in a manner well-known to those skilled in the art.

By practicing with the golf alignment apparatus of the present invention, the golfer is better able to understand the perpendicular relationship between the target line and the line to the ball placement position. Continued practice with the golf alignment apparatus of the present invention in a standardized format enables the golfer to develop optical muscle memory for proper alignment. That is, the positioning and the swing begin to feel natural and may be repeated with or without the use of the golf alignment apparatus during the actual golf game.

In one embodiment, the ground arm 101 is approximately three to four feet in length, and the ball placement line arm 102 is shorter. For instance, in one embodiment, the ball placement line arm 102 is 10–15 inches in length (when fully extended). Also in one embodiment, the shape of the ends of the ground arm 101 may be pointed to facilitate placement of the ground arm in a position directly aimed at the target. The shape of the ends may be rounded or any shape that is aesthetically pleasing or safe as long as the ground arm 101 includes some mechanism (e.g., line of sight marker(s), directional arrow, etc.) which enables the user to place the ground arm 101 in a position parallel to the line of sight. The ground arm 101 may be made of lightweight, durable and weather proof plastic and preferably in a neutral color so as to not distract the golfer from the focus of the ball.

In an embodiment, each track along the side of the ground arm 101 is ¼ inches in height and ¼ inches in depth (from the side of the ground arm 101) running up to two feet along its center. In alternative embodiments, each track runs 6–8 inches or that distance which allows the ball placement line 102 to be positioned anywhere between the total distance from the first ball position (e.g., indicia) to the last ball position (e.g., indicia).

Dual Nature of the Ball Line Placement Arm

Figure 4:
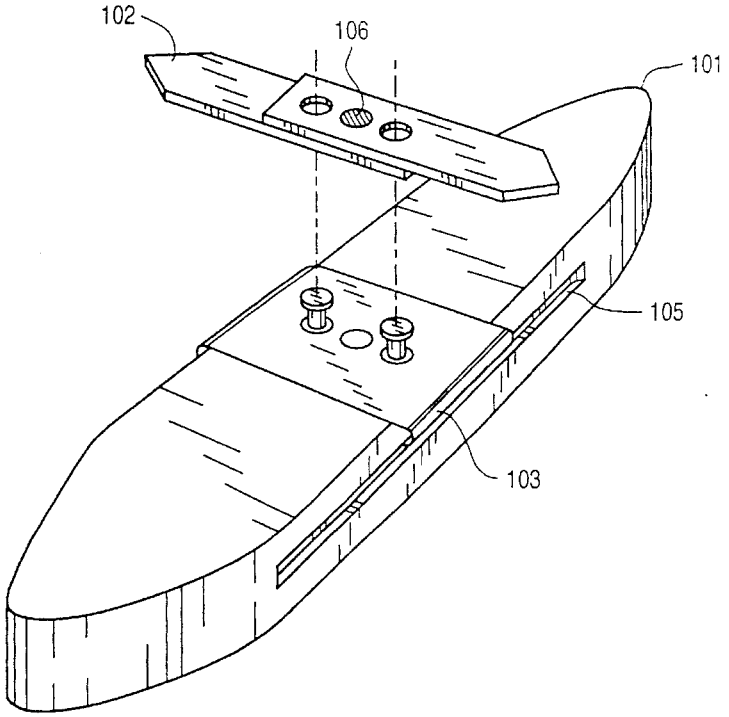
FIG. 4 illustrates a detachable arm separated from the grounded arm and connector of the present invention.

The ball line placement arm 102 may be permanently or detachable from the connector 103. The ball line placement arm 102 may be attached to the ground arm 101 by removable pins, such as pins 104 shown in FIG. 1. The number of pins used to connect the connector 103 to the ball line placement arm 102 is a design choice, but should maintain the ball line placement arm 102 perpendicular to the ground arm 101. In an alternate embodiment, the ball line placement arm 102 snaps onto the connector 103. There are numerous ways in which to design a connection scheme by which the arm 102 is connected to connector 103, including but not limited to, connection schemes which permit the ball line placement arm 102 to be removed from the connector 103. FIG. 4 illustrates the ball line placement arm 102 being detached from connector 103.

Figure 5A:
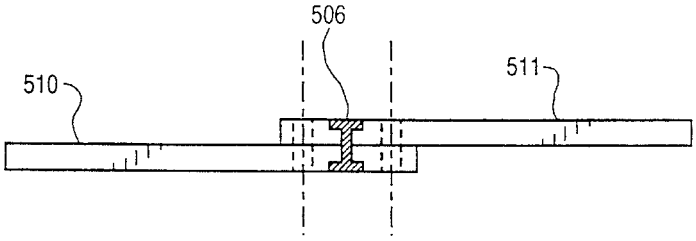
FIGS. 5A and 5B illustrate one embodiment of the portable golf alignment device/ball placement line arm of the present invention.
Figure 5B:
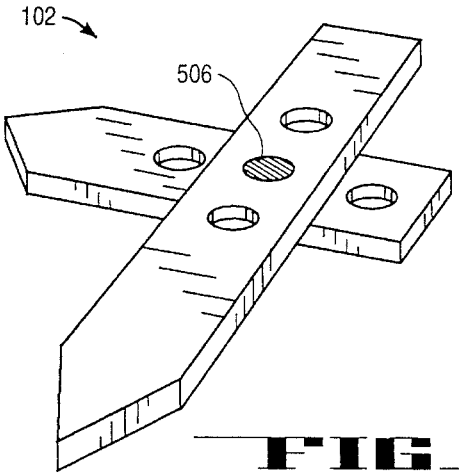

Once removed, the ball line placement arm 102 may be used as a portable alignment device with a hinge 106 or connector (as described below) in the center to permit the forming of a smaller perpendicular arrangement that is equally effective used independently of the larger configuration. That is, arm 102 may be comprised of two portions rotatably coupled so as to enable a portion of the arm 102 to act as a grounded arm while the other portion lies perpendicular to act as a ball line placement device. FIG. 5A illustrates one embodiment of the arm 102 in a single line with the pin holes aligned for the two pieces to enable connection to connector 103. FIG. 5B illustrates two parts of the ball line placement arm 102 in perpendicular position. The connector 506 allows the two parts 510 and 511 to be rotated. Such a connector is readily available. Note that the two parts may be folded on top of each other to allow for pocket portability of the arm 102. In one embodiment, the ball line placement arm 102 is approximately seven or eight inches and may be designed for carrying in a pocket (i.e., pocket portability).

Therefore, the golf alignment apparatus of the present invention includes a larger grounded arm and a smaller detachable or removable arm that is portable and may be carried and easily manipulated for driving range practices as well as fairway practice by the golfer.

The present invention achieves ultimate streamlined construction by the simplicity of its design. The light weight, durable materials make manufacturing inexpensive, creating a simplified, uncomplicated construction with easily movable parts. By being a streamlined device, the golf alignment apparatus of the present invention is a positive motivational factor for practice purposes.

Note that because of its small size and color, the golf alignment apparatus of the present invention does not act as a distraction to the golfer. It is important that the golfer does not lose focus of the target line or the ball placement line because of a complicated fixture or apparatus in front of him. The present invention avoids such a distraction, thereby making an alignment device of the present invention both marketable and desirable.

Alternative Embodiments

Figure 6A:
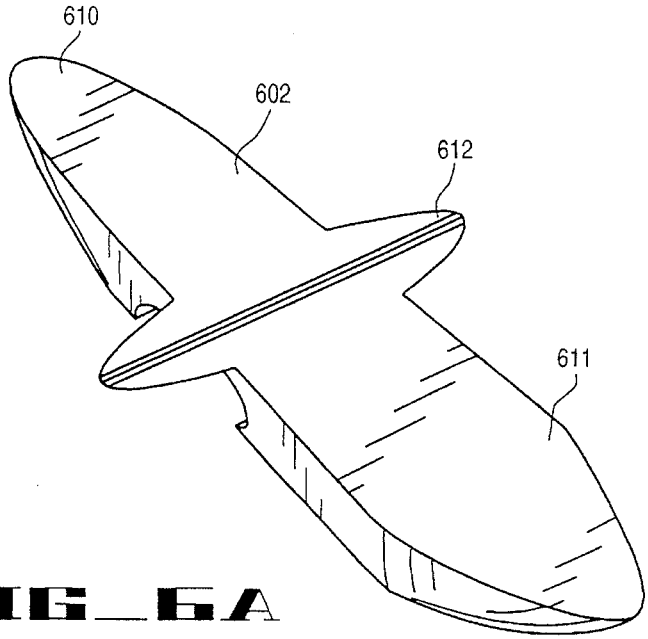
FIGS. 6A, 6B and 6C illustrate alternative embodiments of the ball placement line arm having two parts hinged together.
Figure 6B:
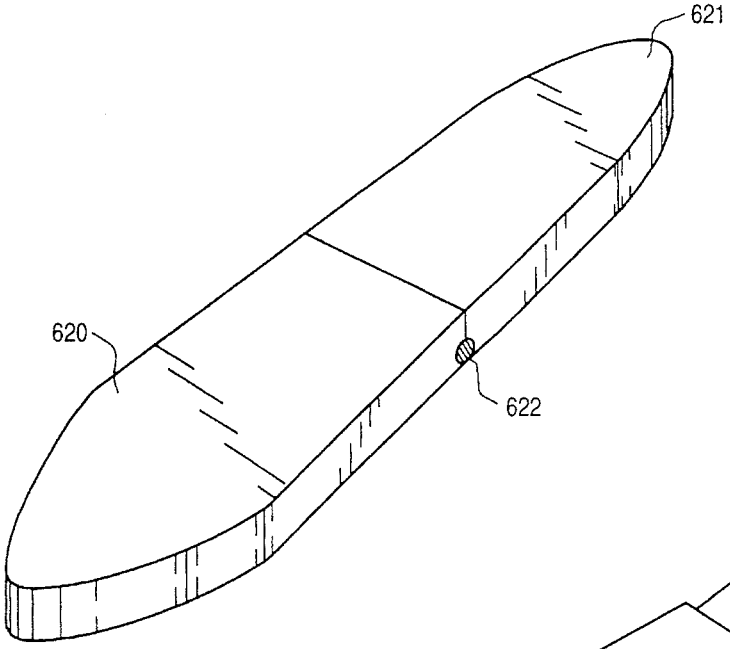
Figure 6C:
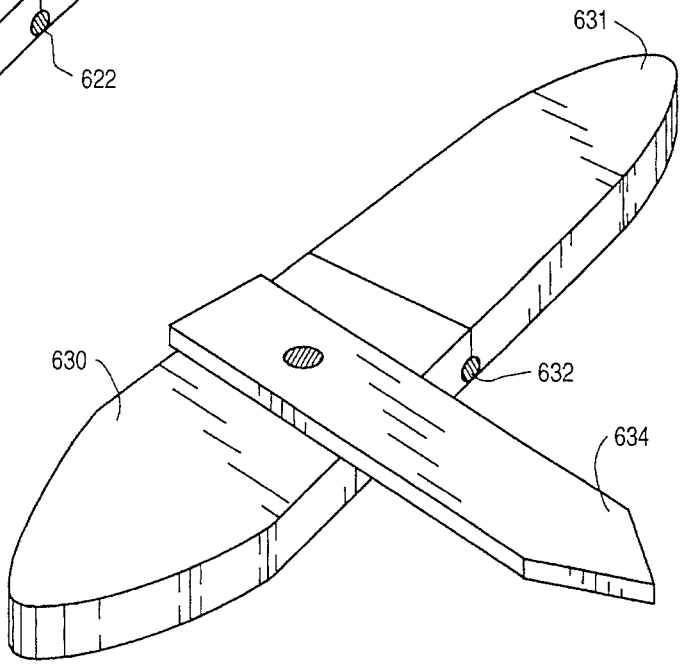

FIG. 6A–C illustrate alternative embodiments of the ball line placement arm 102. Referring to FIG. 6A, arm 602 includes two portions 610 and 611 that are coupled together by a hinge 612. In one embodiment, the two parts 610 and 611 are identical in size and symmetrically coupled to opposite sides of the hinge 612. In one embodiment, parts 610 and 611 are each 7 inches in length. The hinge 612 allows the two parts to be folded on each other to facilitate portability. In one embodiment, the distance across the hinge 612 is 3 inches.

Referring to FIG. 6B, an alternative embodiment of arm 102 is shown in which two parts 620 and 621 are hinged together by hinge 622, where hinge 622 allows side A of parts 620 and 621 to be brought closer together. In this manner, parts 620 and 621 may be placed in position perpendicular to each other for use as an alignment device and positioned together for portability. Note that in one embodiment, parts 620 and 621 are seven inches in length.

Referring to FIG. 6C, an alternative embodiment of arm 102 is shown having two parts 630 and 631 hinged together by hinge 632 that enables each of their B sides to be brought together for portability. A third part 634 is rotatably coupled to part 630 and may be positioned perpendicular to part 630 (and 631) when arm 602 is used as a portable alignment device. In one embodiment, parts 630, 631 and 634 are seven inches in length.

Figure 7A:
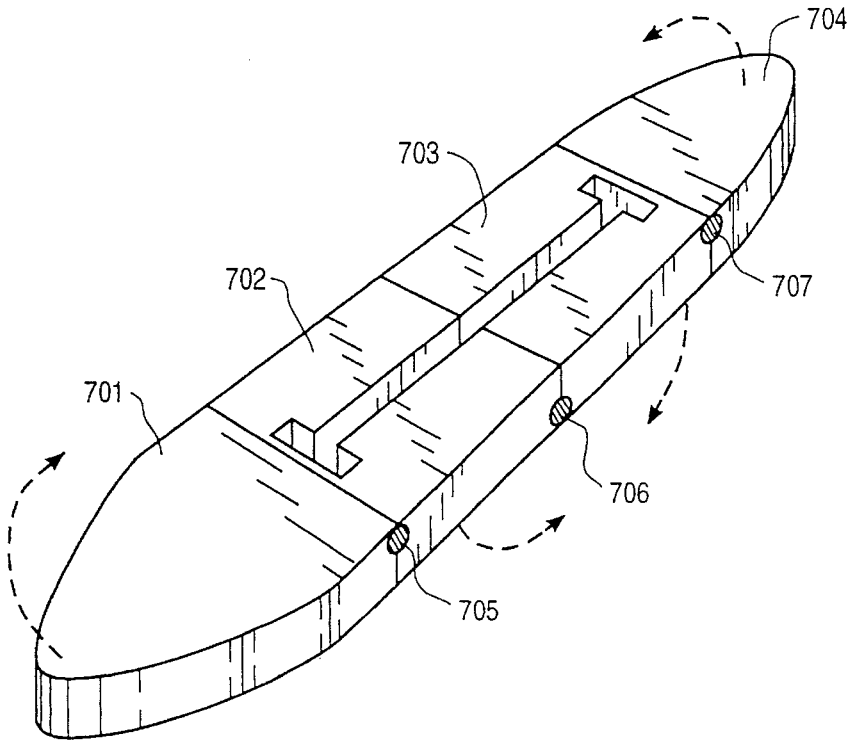
FIG. 7A illustrates one embodiment of the ground arm of the present invention that includes multiple sections coupled together with the use of hinges.
Figure 7B:
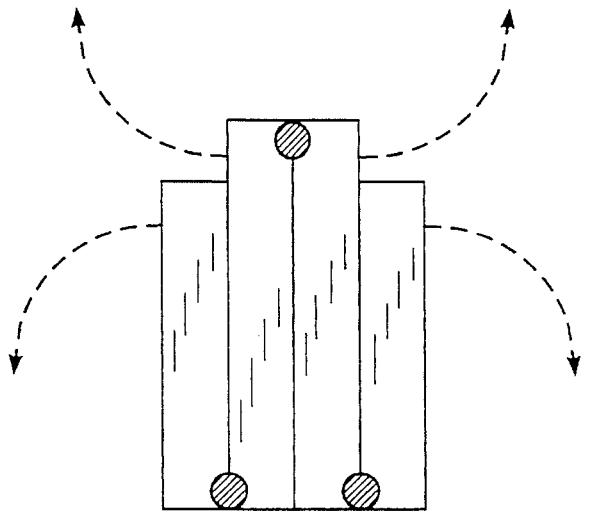
FIG. 7B illustrates the embodiment of the ground arm of FIG. 7 folded into a compact shape.

FIG. 7A illustrates an alternative embodiment of the ground arm of the present invention as claimed. Referring to FIG. 7A, the ground arm is shown with multiple portions 701–704. Each of the portions are coupled together by hinges 705–707 that enable the ground arm to be collapsed upon itself by moving each of the sections 701–704 in the directions indicated. The resulting compact structure is shown in FIG. 7B. Note that the ground arm of FIG. 7A includes a single track on top. A description of use of such a ground arm is described in conjunction with FIGS. 9A–9C. In an alternative embodiment, the ground arm may have tracks on each side.

Figure 8:
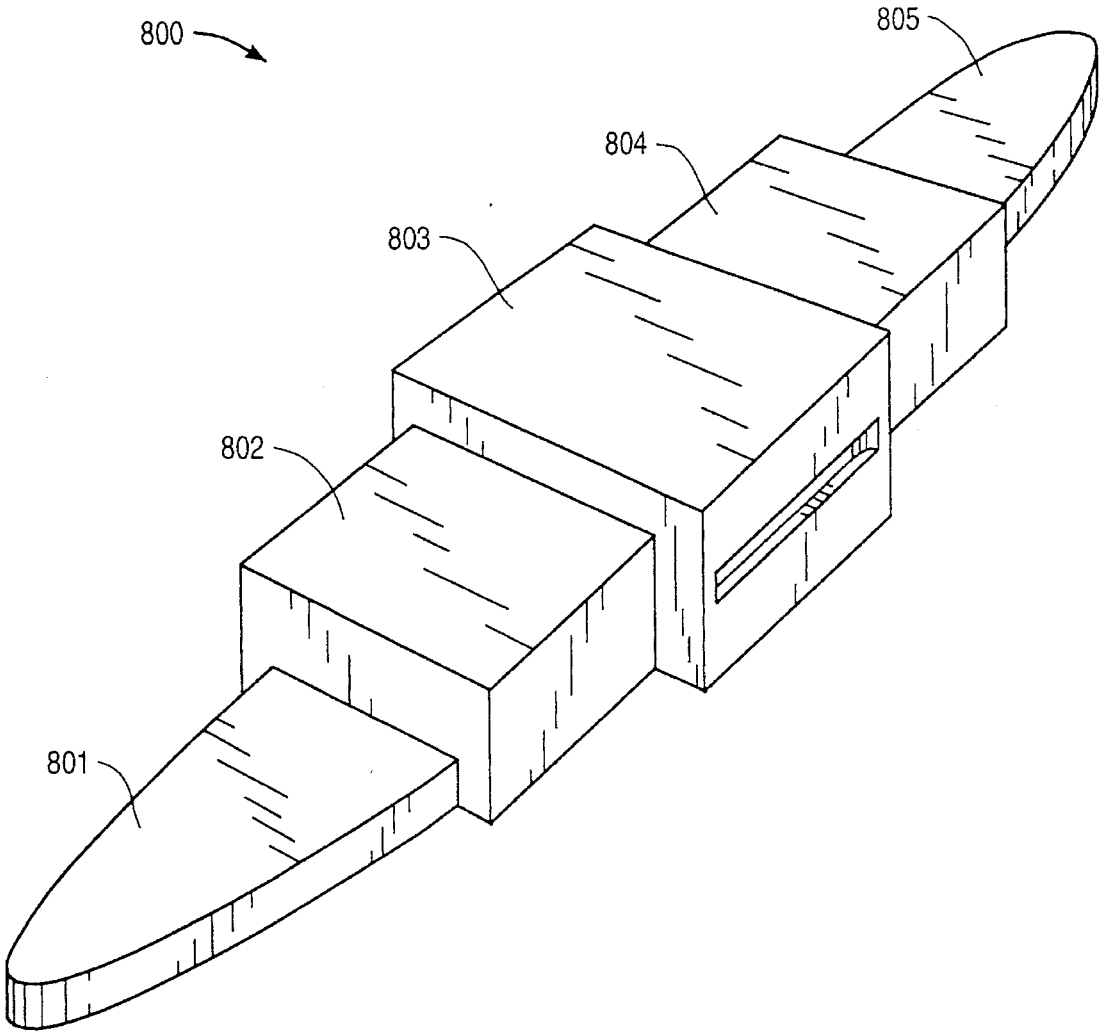
FIG. 8 is an alternate embodiment of the grounded arm.

FIG. 8 illustrates an alternative embodiment of the ground arm which includes multiple sections 801–805 that may be partially or fully collapsible within other sections to create a compact device. For instance, section 801 may be partially or fully inserted into section 802, which may be partially or fully inserted into section 803, while section 805 may be fully or partially inserted into section 804, while section 804 may be partially or fully inserted into section 803. The results of such insertion causes ground arm 800 to be collapsed into a more compact and portable embodiment.

When an individual desires to use the ground arm 800, the sections are pulled out from their inserted positions to be fully extended. When each of the sections is fully extended, they either lock into place at their point of contact with the neighboring section(s) or the size of adjoining sections causes them to be held in place. That is, the portion of section 801 that is making contact with section 802 is larger in size than that portion of section 802 into which section 801 extends so as to cause it to be held in place when extended, which is much like portable hand-held telescopes which collapse into a shorter cylindrical unit.

Note that the telescopic embodiment of FIG. 8 may use either a ball placement line arm such as shown in FIG. 1, 2, 5 or a hinged ball placement line arm, such as shown in FIG. 6.

Although only five sections are shown, any number of sections may be used and is a design choice based on, for instance, desired length of the ground arm and durability.

Figure 9A:
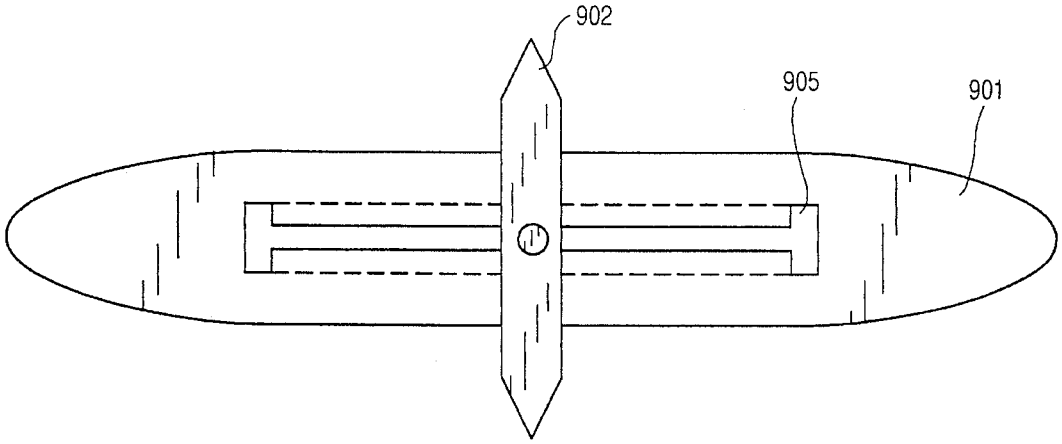
FIGS. 9A–C illustrate an embodiment of the golf alignment apparatus of the present invention that does not require a slidable connector.
Figure 9B:
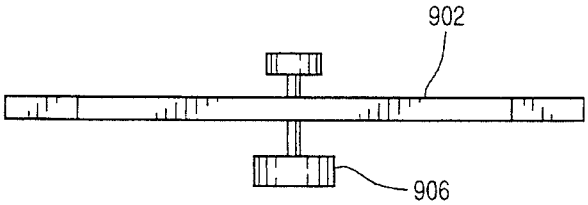
Figure 9C:
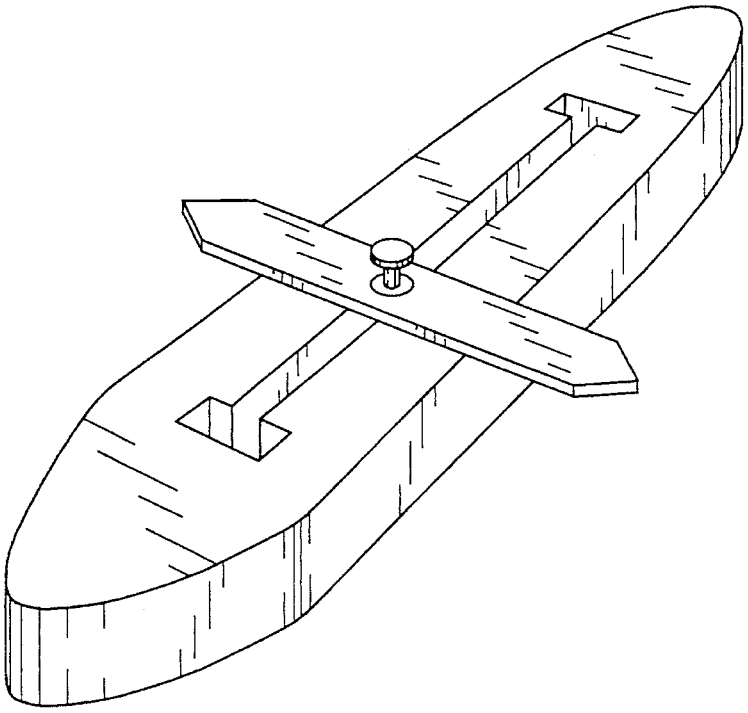

FIGS. 9A–C illustrates an alternate embodiment of the golf alignment apparatus of the present invention that does not have a separate connector. Referring to FIG. 9A, a ground arm 901 is shown having a single track 905 that runs along the top of the ground arm 901. The track 905 has two insertion holes for receiving a knob-like pin 906 coupled to the ball line placement arm 902, as shown in FIG. 9B. Once inserted, the ball line placement arm 902 may slide along track 905 for use as described above. In one embodiment, the ball line placement arm 902 may comprise the ball placement line shown in FIG. 5A–B when the hinged area couples to the knob-like pin 906 and may be removed to act as a portable alignment device.

Figure 10A:
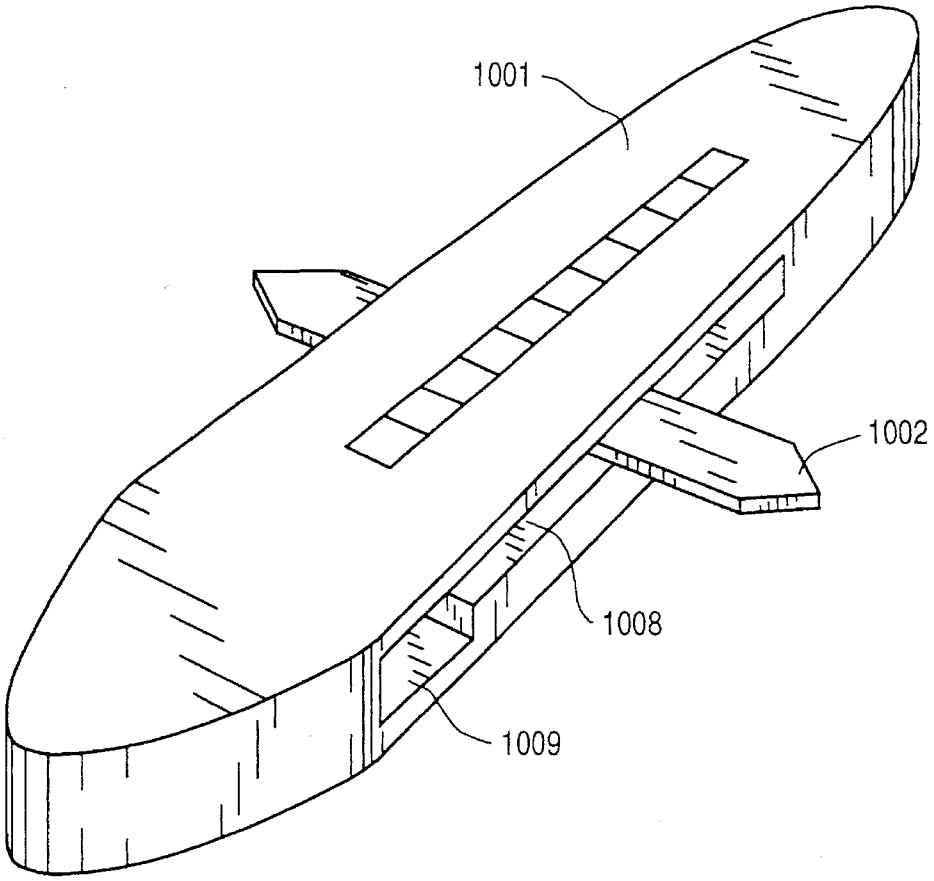
FIGS. 10A and B illustrate an alternate embodiment of the golf alignment apparatus of the present invention that does not require a slidable connector.
Figure 10B:
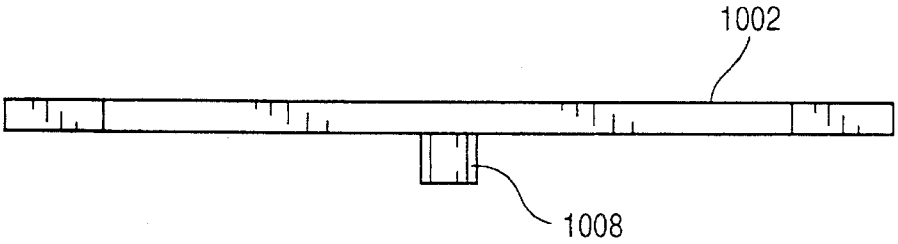

FIGS. 10A and B illustrates another alternate embodiment of the golf alignment device of the present invention. Referring to FIG. 10A, the track (not shown) that permits the movement of the ball line placement arm 1002 (FIG. 10B) is located within the interior of the ground arm, while the visible indicia remain on the top of ground arm 1001. Referring to FIG. 10B, the bottom side of the ball line placement arm 1002 is shown having a track guide 1008 which maintains the ball line placement arm 1002 in the track within the ground arm 1001 (not shown). A notched portion 1009 in ground arm 1001 permits the initial insertion of the ball line placement arm 1002. The notched portion 1009 is sized for reception of the track guide 1008.

Figure 11:
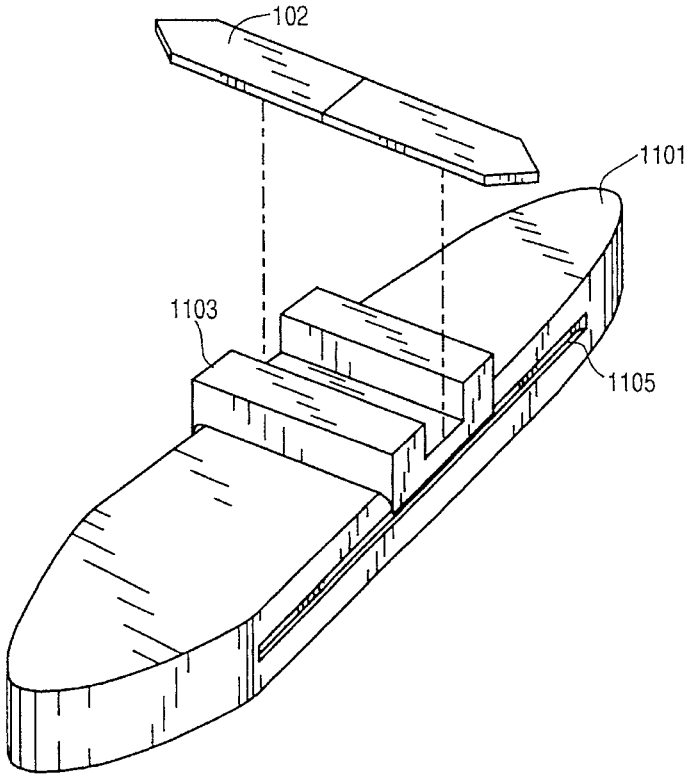
FIG. 11 illustrates an alternative embodiment of the alignment device of the present invention that uses the hinged arm of FIG. 6B.

FIG. 11 illustrates an alternative embodiment in which the connector 103 of FIG. 1 (and 2) is replaced with a grooved slide (e.g., connector) that is designed to snugly or loosely receive a ball placement line arm, such as that shown in FIG. 6B.

Whereas, many alterations and modifications of the present invention will no doubt become apparent to a person of ordinary skill in the art after having read the foregoing description, it is to be understood that the particular embodiment shown and described by way of illustration are in no way to be considered limiting. Therefore, reference to the details of the various embodiments are not intended to limit the scope of the claims which themselves recite only those features regarded as essential to the invention.

Thus, a golf alignment apparatus has been described.

I claim:

1. A golf alignment apparatus comprising:

a first elongated member for placement in a position parallel to a target line by which a golfer is aiming, wherein the first elongated member includes visible indicia corresponding to ball placements for individual golf clubs with respect to a foot of the golfer closest to a target, and further wherein the first elongated member comprises at least one track;

a connector slidably attached to the first elongated member to move in a direction perpendicular to the first elongated member, wherein the connector slides in said at least one track; and a second elongated member removably attached to the connector and maintained perpendicular to the first elongated member for providing a ball placement line based on individual golf club selection by the golfer.

2. The golf alignment apparatus defined in claim 1 wherein the first elongated member is longer than the second elongated member.

3. The golf alignment apparatus defined in claim 1 wherein the connector comprises a transparent portion to allow viewing of the visible indicia on the first elongated member through the connector.

4. The golf alignment apparatus defined in claim 1 wherein the second elongated member is operable as a portable alignment device when removed from attachment to the connector.

5. The golf alignment apparatus defined in claim 1 wherein the visible indicia comprises permanent markings along at least one side of the first elongated member.

6. A golf alignment apparatus comprising:

a first elongated member for placement in a position parallel to a target line by which a golfer is aiming, wherein the first elongated member includes visible indicia corresponding to ball placements for individual golf clubs with respect to a foot of the golfer closest to a target, and further wherein the first elongated member comprises at least one track;

a connector slidably attached to the first elongated member to move in a direction perpendicular to the first elongated member, wherein the connector slides in said at least one track; and a second elongated member removably attached to the connector and maintained perpendicular to the first elongated member for providing a ball placement line based on individual golf club selection by the golfer, wherein the second elongated member comprises a first portion and a second portion rotatably coupled to each other to enable a range of motion from 0° to 180°, such that the first portion may be positioned perpendicular to and parallel to the second portion.

7. A golf alignment apparatus comprising:

a first elongated member for placement in a position parallel to a target line by which a golfer is aiming, wherein the first elongated member includes visible indicia corresponding to ball placements for individual golf clubs with respect to a foot of the golfer closest to a target, wherein the visible indicia comprises movable indicia to enable an individual to set the ball placements of individual golf clubs to a plurality of settings;

a connector slidably attached to the first elongated member to move in a direction perpendicular to the first elongated member; and a second elongated member removably attached to the connector and maintained perpendicular to the first elongated member for providing a ball placement line based on individual golf club selection by the golfer.

8. A golf alignment apparatus comprising:

a first elongated member for positioning parallel to a target line by which a golfer is aiming, wherein the first elongated member comprises at least one track and a plurality of visible indicia corresponding to ball placements for individual golf clubs with respect to a foot of the golfer closest to a target;

a connector slidably attached to the first elongated member to move in a direction perpendicular to the first elongated member via said at least one track;

a second elongated member shorter in length than said first elongated member, operable as a portable golf alignment device and removably attached to the connector, such that the connector maintains the second elongated member perpendicular to the first elongated member and the second elongated member provides a ball placement line based on individual golf club selection according to the plurality of visible indicia.

9. The golf alignment apparatus defined in claim 8 wherein the connector comprises a transparent portion to allow viewing of the visible indicia on the first elongated member through the connector.

10. The golf alignment apparatus defined in claim 8 wherein the second elongated member is operable as a portable alignment device when removed from attachment to the connector.

11. The golf alignment apparatus defined in claim 8 wherein the second elongated member comprises a first portion and a second portion rotatably coupled to each other to enable a range of motion from 0° to 180°, such that the first portion may be positioned perpendicular to and parallel to the second portion.

12. The golf alignment apparatus defined in claim 8 wherein the visible indicia comprises permanent markings along at least one side of the first elongated member.

13. The golf alignment apparatus defined in claim 8 wherein the visible indicia comprises movable indicia to enable an individual to set the ball placements of individual golf clubs to a plurality of settings.

14. The golf alignment apparatus defined in claim 8 wherein the first elongated member comprises a plurality of sections coupled together, such that a substantial portion of some sections are inserted into other sections to reduce length of the elongated member for portability of the golf alignment apparatus.

15. The golf alignment apparatus defined in claim 14 wherein the second elongated member comprises a first portion hinged to a second portion.

16. The golf alignment apparatus defined in claim 8 wherein the second elongated member comprises a first portion hinged to a second portion.

17. The golf alignment apparatus defined in claim 8 wherein the first elongated member comprises a plurality of sections coupled together to enable folding of the first elongated member into a length shorter than the first elongated member prior to folding.

18. A golf alignment apparatus comprising:

a first elongated member for positioning parallel to a target line by which a golfer is aiming, wherein the first elongated member comprises a track and a plurality of visible indicia corresponding to ball placements for individual golf clubs with respect to a foot of the golfer closest to a target;

a second elongated member slidably and removably coupled to the track of the first elongated member, wherein the second elongated member is positioned perpendicular to the first elongated member and provides a ball placement line based on individual golf club selection using the plurality of visible indicia, wherein the track is contained within an inner portion of the first elongated member and a portion of the second elongated member is contained within the first elongated member when attached.

19. A golf alignment apparatus comprising:

a first elongated member for positioning parallel to a target line by which a golfer is aiming, wherein the first elongated member comprises at least one track and a plurality of visible indicia corresponding to ball placements for individual golf clubs with respect to a foot of the golfer closest to a target;

a connector slidably attached to the first elongated member to move in a direction perpendicular to the first elongated member via said at least one track;

a second elongated member shorter in length than said first elongated member, operable as a portable golf alignment device and removably attached to the connector, such that the connector maintains the second elongated member perpendicular to the first elongated member and the second elongated member provides a ball placement line based on individual golf club selection according to the plurality of visible indicia a slider coupled to the second elongated member, wherein the track includes at least one receptor hole adapted to receive the slider, such that the slider is inserted through the receptor hole and slides through the track when the second elongated member is moved to permit positioning of the second elongated member with respect to the first elongated member.

* * * * *